United States Patent [19]

Gottlieb

[11] Patent Number: 4,483,120

[45] Date of Patent: Nov. 20, 1984

[54] HINGED METAL WEB FOR TRUSS STRUCTURES AND METHOD OF MAKING

[75] Inventor: Robert Gottlieb, Miami, Fla.

[73] Assignee: Gang-Nail Systems, Inc., Miami, Fla.

[21] Appl. No.: 381,220

[22] Filed: May 24, 1982

[51] Int. Cl.[3] ..... E04C 3/02

[52] U.S. Cl. ..... 52/693; 52/645; 52/641; 29/432

[58] Field of Search ..... 52/693, 694, DIG. 6, 52/641, 645; 411/461, 466, 467, 468; 182/22, 23, 24, 165; 29/432

[56] References Cited

U.S. PATENT DOCUMENTS

| | | | |
|---|---|---|---|
| Re. 31,234 | 5/1983 | Jureit | 403/163 |
| 306,974 | 10/1884 | Stowe | 182/24 |
| 383,243 | 5/1888 | Peacock | 182/24 |
| 519,535 | 5/1894 | Koehler | 182/165 |
| 722,865 | 3/1903 | Lorenz | 182/24 |
| 4,078,352 | 3/1978 | Knowles | 52/693 |
| 4,089,148 | 5/1978 | Oehmsen | 52/693 |

FOREIGN PATENT DOCUMENTS

| | | | |
|---|---|---|---|
| 2037397 | 2/1972 | Fed. Rep. of Germany | 52/693 |

*Primary Examiner*—John E. Murtagh
*Assistant Examiner*—Kathryn L. Ford
*Attorney, Agent, or Firm*—LeBlanc, Nolan, Shur & Nies

[57] ABSTRACT

A hinged metal web member for use in forming a truss or joist assembly. In one embodiment, the web member includes a pair of leg members having connector plates at the upper and lower end portions. Each connector plate has a plurality of teeth struck therefrom, with all of the teeth extending from a common side of the web member. The leg members are joined at their upper end portions by a hinge which allows the leg members to be folded together for shipping and storage, then opened to assume a V configuration when forming a truss or joist, A series of such web members may be hingedly connected to provide a web assembly of the required length and configuration. The hinge connection should be sufficiently strong and rigid to allow the web member to be utilized under conditions to be encountered in truss assembly, yet sufficiently pliable that the hinge may be snapped or broken apart to obtain a web member of the desired length.

6 Claims, 18 Drawing Figures

Fig. 6
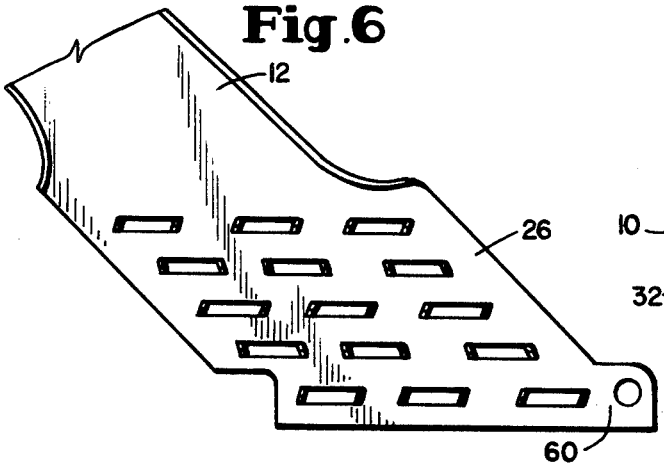
Fig. 7
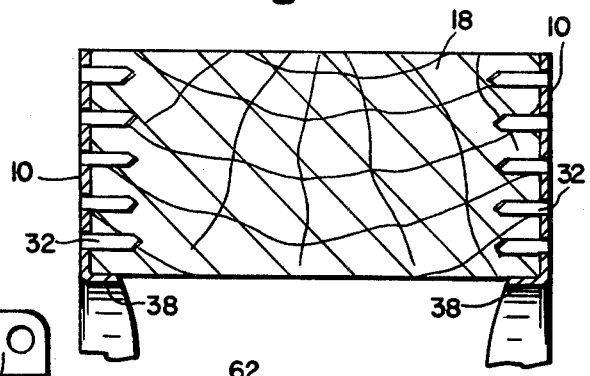
Fig. 8
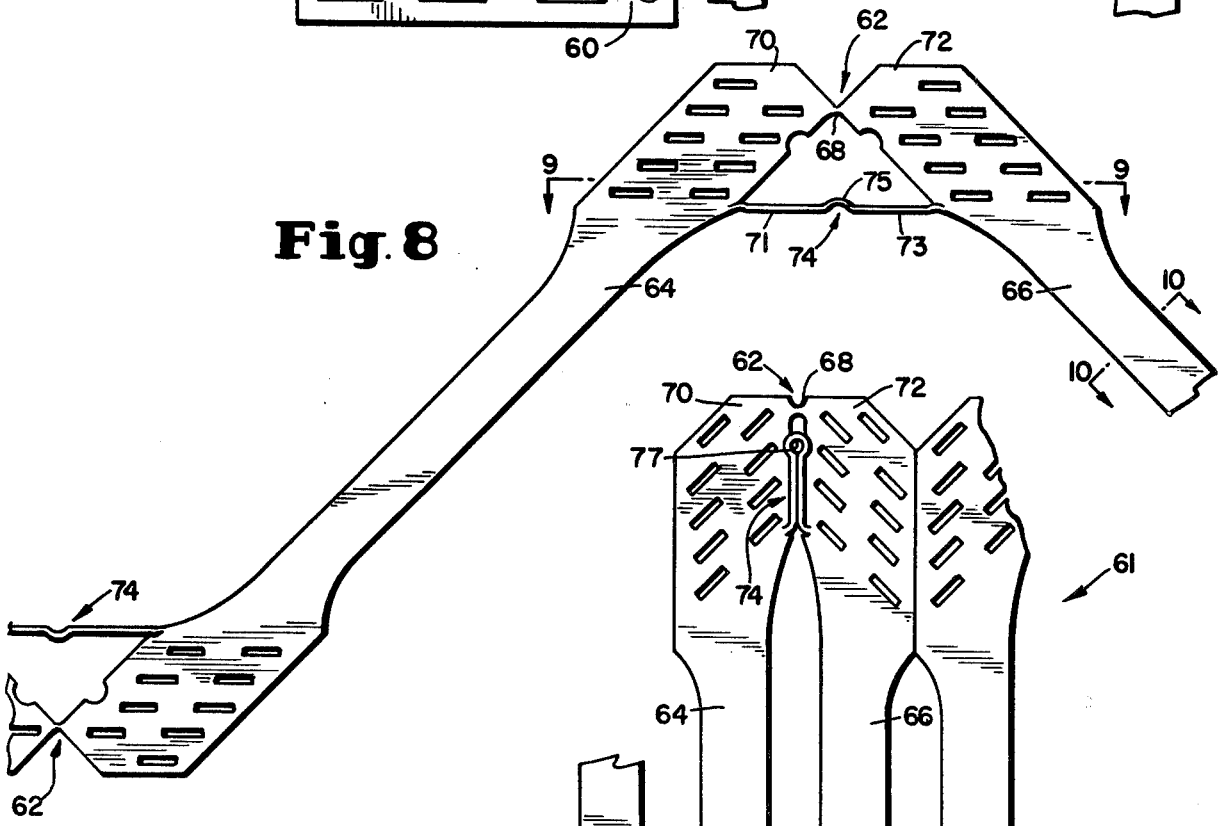
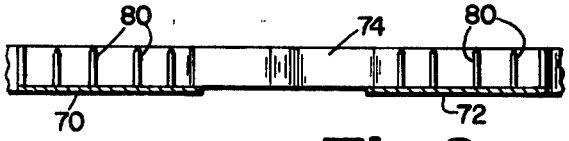
Fig. 9
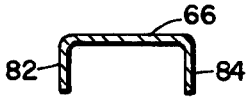
Fig. 10
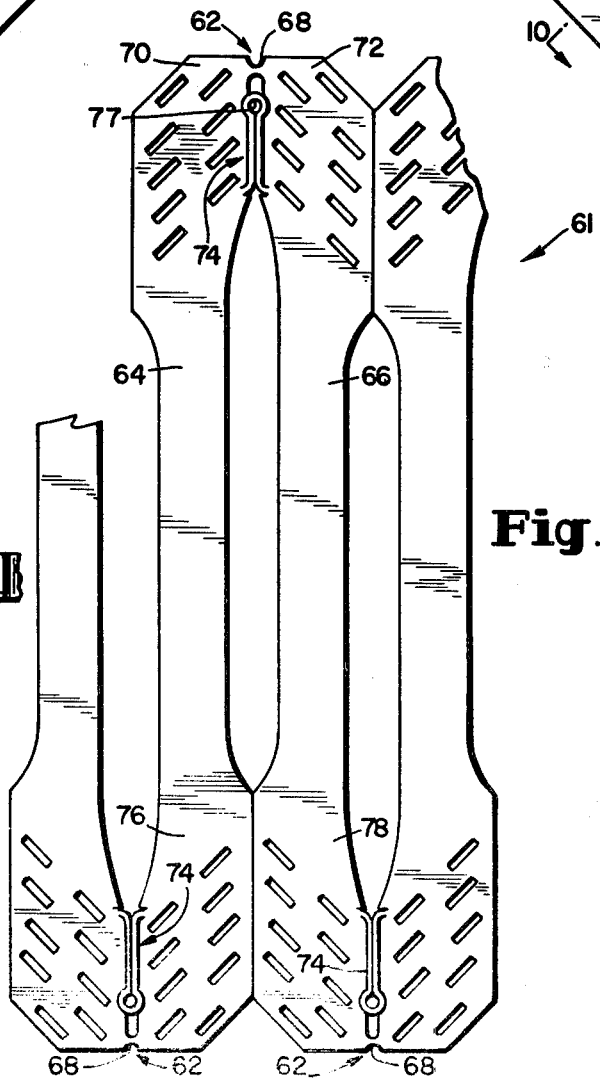
Fig. 11

HINGED METAL WEB FOR TRUSS STRUCTURES AND METHOD OF MAKING

BACKGROUND OF THE INVENTION

The present invention relates to wooden structures and hinged metal web connectors for joining wooden members to form the wooden structures such as in the construction of wooden truss or joist assemblies for enabling such wooden structures to be used to support structural loads.

In constructing various types of wooden truss assemblies, including both certain types of roof trusses and floor joists, it has been common to use large wooden structural members, e.g. wooden members having a width of at least 10 inches. Such large wooden members, however, are becoming increasingly difficult to find and as a result having increased tremendously in cost. Consequently, various alternatives have been sought to enable the construction of such trusses employing more commonly available wooden members such as 2×4 wooden strips. In seeking to find such alternatives, there have been two primary criteria that had to be met. First, the alternative devices had to be able to withstand large compressive loads so that the trusses that were constructed could be used for bearing substantial loads. Secondly, it was considered desirable to develop alternative devices that could be prefabricated at a manufacturing plant and then easily shipped to a building site without a high degree of risk of incurring damage to the truss structure.

One type of device that has been developed for prefabricating such structural trusses is described in U.S. Patent Application Ser. No. 337,671 filed Jan. 7, 1982, commonly assigned, which application is incorporated herein by reference.

Various types of truss assemblies are also described in the following U.S. Patent Nos. 2,803,317 to Henderson; 3,152,347 to Williams; 3,729,877 to Hall; 3,783,573 to Vaughan; 3,823,522 to Jureit et al; 4,089,148 to Oehmsen et al; and 4,126,974 to Hardin. Each of these patents illustrates a hinged and/or pivoted truss assembly. In general, the references describe elongated members that are interconnected by a hinged member located at the ends of the elongated members. Of these patents only one, the Jureit et al patent, illustrates any hinged members having teeth struck out from the plates. In the Jureit et al patent, however, the two hinged members are used so as to enable two elongated wooden members to be hinged with respect to each other.

Several of the other patents such as the Henderson patent and the Hall patent illustrate hinged metal members for interconnecting elongated truss or frame members. In addition, several of these patents, particularly the Williams, Hall, Vaughan and Hardin patents, disclose collapsible or foldable connector members which enable the connector assembly to be more easily shipped. None of these patents, however, is concerned with the use of a hinged metal web having connector nail plates at the end portions thereof for joining two elongated wooden members which are arranged so as to extend parallel to each other with a spacing therebetween, thus forming a truss or joist assembly.

SUMMARY OF THE INVENTION

An object of the present invention is to provide an improved metal web member for use in prefabricating truss or joist assemblies capable of bearing substantial structural loads.

Another object of the present invention is to provide a hinged metal web member for use in prefabricating truss or joist assemblies, with each web being hinged to both adjacent webs at each end, forming an accordian type assembly of webs which can be closed into a compact group for shipping and handling, then opened for speedy truss fabrication.

A further object of the present invention is to provide a hinged metal web member which is capable of assuming either a V or W shape or various combinations thereof so as to provide a choice of configurations during the construction of truss or joist assemblies.

Still another object of the present invention is to provide a hinged metal web member having an improved stop member construction for positioning the hinged components of the web.

Still another object of the present invention is to provide a hinged metal web member having a plurality of teeth struck out from connector plates located at the extremities of the web member for attachment of the web to wooden members in the construction of truss or joist assemblies.

The above and other objects of the present invention are accomplished by the hinged metal web member of the present invention. In one embodiment, the present invention provides an accordian type assembly of a plurality of hinged webs which can be positioned with each web in close contact with adjacent webs, thus providing an arrangement of contiguous webs which form a compact group for shipping and handling. The accordian assembly can be readily opened for speedy truss fabrication. The hinged web of the present invention includes a break-away feature which allows the web member to be strong and rigid enough to be handled without coming apart, yet weak enough to be snapped apart where and when desired.

The break-away feature of the present web member permits the truss fabricator to have at his disposal, from a single inventory of assembled webs:(a) a ½ V web:(b) a full V web: (c) a double V or W web; and (d) numerous other configurations. The hinged connection can be made, for example, by intially forming both webs connected by a hinge member in a single piece construction or, alternatively, by using a relatively weak rivet or eyelet which joins separately constructed webs.

A further aspect of the present invention involves the use of a formed stop member which allows the web member to be opened only to the proper position for correctly forming the V or W configuration. The break-away feature of the present hinge connection may also be used in conjunction with a permanent rivet or pivot member so that the present hinge feature need not be used in a long series of webs attached by break-away hinges but can be used so that hinged web members are interspersed with web members having a permanent V or W configuration.

BRIEF DESCRIPTION OF THE DRAWINGS

FIG. 6 is an enlarged view of the rear face of a connector plate at one of the extremities of the hinged metal web member shown in FIG. 3.

FIG. 7 is an enlarged sectional view taken along line 7—7 of FIG. 1.

FIG. 8 is a partial front elevation of an alternative embodiment of the hinged metal web of the present invention.

FIG. 9 is a sectional view taken along line 9—9 of FIG. 8, showing part of the hinged portion of the hinged metal web of FIG. 8.

FIG. 10 is a sectional view through one of the legs of the hinged metal web of FIG. 8 taken along line 10—10.

FIG. 11 is a front elevation of the embodiment of FIG. 8, shown with hinged members folded together about the respective hinges into a compact unit for shipping or storage purposes.

DESCRIPTION OF THE PREFERRED EMBODIMENTS

Figures 1, 2, 3, 4A, 4B, 5A, 5B:
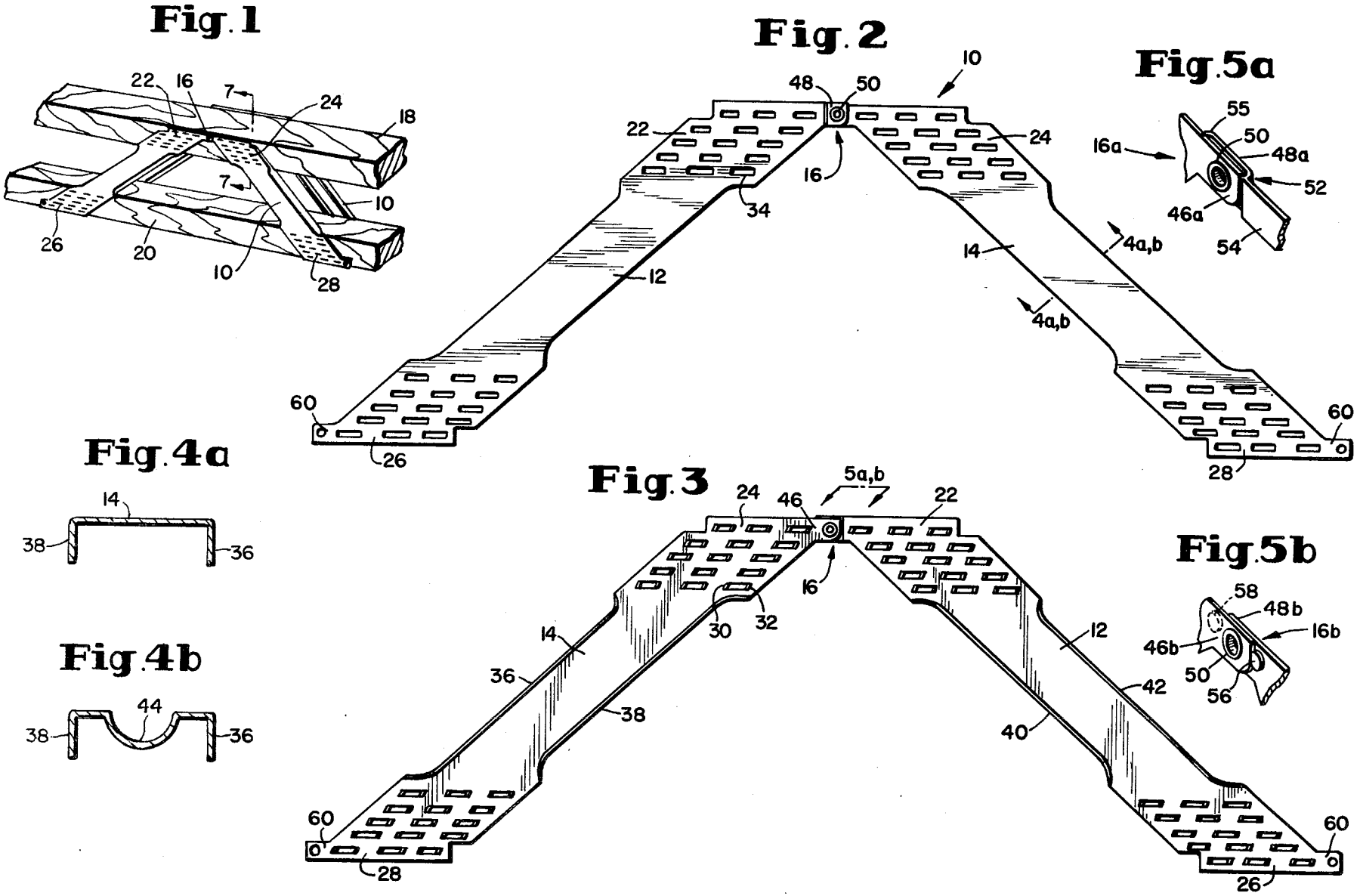
FIG. 1 is a perspective view of a portion of a joist structure constructed in accordance with the present invention.
FIG. 2 is a front elevation of a V-shaped hinged metal web member constructed in accordance with the present invention.
FIG. 3 is a rear elevation of the hinged metal web member shown in FIG. 2.
FIGS. 4*a* and 4*b* are sectional views of alternative embodiments of the leg members of the hinged metal web taken along line 4*a, b*—4*a, b* of FIG. 2.
FIGS. 5*a* and 5*b* are perspective views of alternative embodiments of the hinged portion of the hinged metal web taken along line 5*a, b*—5*a, b* of FIG. 3.

In the embodiments of the invention as shown in FIGS. 1 through 7, there is provided a hinged metal web member 10 which includes legs 12, 14 joined by hinged portion 16. As shown in FIG. 1, a pair of elongated wooden members 18, 20 which are spaced apart and extend in substantially parallel directions are interconnected on opposite sides by a pair of V-shaped hinged metal web members 10 to provide a joist assembly. Each of the members 10 has a connector plate 22, 24 at the respective upper ends of the legs 12, 14 which together form the apex of member 10. Connector plates 26, 28 are also provided at the two lower extremities of legs 12, 14.

A series of hingedly connected metal web members 10 may be arranged on each side of the two wooden members 18, 20, as described in more detail hereinafter, with the members 10 normally being arranged so that a web member 10 on one side of the wooden members 18, 20 will be aligned with a corresponding web member 10 on the opposite side of wooden members 18, 20. The number of interconnected web members 10 arranged on each side of the wooden members 18, 20 and the particular configuration thereof, i.e., whether a V or W configuration or some combination thereof, will depend both on the length of the wooden members and on the compressive loads to which such members will be subjected.

Each of the connector plates of hinged web 10 has a plurality of pairs of teeth such as teeth 30 and 32, with all of the teeth extending from the same side or face of the respective connector plate. Teeth 30 and 32 when struck out leave a slot therebetween such as slot 34. In one embodiment the teeth in the connectors at the apex and extremities of the web member 10 are arranged in rows which extend in the same general direction as the adjacent legs 12 and 14, respectively. The teeth may be struck by the use of any suitable means known in the art, one example of which is described in allowed U.S. patent application Ser. No. 71,551 to Moyer et al filed Aug. 31, 1979 and commonly assigned. The subject matter of this application is hereby incorporated by reference.

As shown in FIGS. 3 and 4*a* a flange extends along each side of the legs 12, 14. Thus two flanges 36, 38 extend along the sides of leg 14 in the same direction longitudinally as the rows of teeth struck out from the connector plates and also extending from the same side of the web 10 as the teeth. Similar flanges 40, 42 extend outwardly along the sides of leg 12.

The flange that extends along the outer side of each leg such as shown by flange 42 in FIG. 3 turns horizontally outwardly at the upper portion thereof to extend along the bottom of connector plate 22. This extended end portion of the flange 42 and the corresponding portions of flanges 36, 38 and 40 serve to abut the bottom edge of upper wooden member 18, as shown in FIG. 1, and thus position the web member 10 on the wooden member 18. In a similar manner, the lower end portions of the flanges of legs 12, 14 turn horizontally outwardly from the respective legs 12, 14 to extend along the top of respective connector plates 26, 28. These extended lower portions of the flanges abut the top edge of lower wooden member 20 and thus serve to position the web member 10 on the lower wooden member 20. In this manner the spacing between the two wooden members and their relationship with the hinged metal web 10 can be easily and properly maintained.

In FIG. 4*b* there is shown an alternative embodiment in which a groove 44 extends the length of each of the legs 12, 14 in the same direction as the rows of teeth that are punched out from the connector plates of the web member 10. Such grooves 44 form protractions that extend outwardly from the rear face of the legs 12, 14 in the same direction as the teeth which are struck from the connector plates.

The teeth of the metal web members, such as teeth 30, 32, are embedded into the wooden members 18, 20 during construction of the truss or joist assembly. As shown in FIG. 7, the teeth of the two web members 10 are embedded in wooden member 18 which rests on flange sections including section 38 for proper positioning of the wooden member 18.

The construction of the hinge 16 employed to join the two members 12, 14 may be any of various configurations which will provide the desired characteristics as described herein. In general, the hinge connection should be sufficiently strong and rigid so as to allow the web member 10 to be handled and positioned without coming apart, yet sufficiently weak or pliable so that the hinge 16 may be snapped or broken apart where and when desired. In one embodiment, as shown in FIGS. 2, 3, 5*a* and 5*b*, the hinge is formed by overlapping tab members 46, 48 joined by a rivet 50 in a conventional manner.

In the embodiment of the hinge 16*a* as shown in FIG. 5*a*, one of the tab members 46*a* abuts a shoulder 52 formed by the other tab member 48*a* and the adjacent portion 54 of the respective leg member, so that tab member 46*a* and portion 54 are aligned in a coplanar relationship. Stop member 55 is located on the upper outer end of member 48*a* and extends into the plane of member 46*a* so as to prevent any further relative movement between members 46*a* and 48*a* in a direction which would further increase the angle between members 12 and 14 once the V configuration has been attained. Thus the combination of the snug fit of member 46*a* with shoulder 52 and the position of stop member 55 provide for proper positioning of the legs 12, 14 in the desired V configuration.

In the embodiment of the hinge 16*b* as shown in FIG. 5*b*, a stop member 56 in the form of a raised lug is positioned on tab member 48*b* so as to bear against the outer edge of tab member 46*b* when the proper angle between legs 12 and 14 has been attained. A similar stop member 58 is positioned on tab member 46*b* to bear against the outer edge of tab member 48*b*. Thus the stop members 56, 58 interact to prevent further relative movement between members 46*b* and 48*b* in a direction which would further increase the angle between members 12 and 14, once the correct V configuration has been attained.

While the hinge constructions described herein are of the break-away type, it is within the scope of the invention to employ such break-away hinges in a web assembly in which webs with break-away hinges are interspersed with other web members having a permanent V or W configuration.

As shown in FIGS. 2, 3 and 6, a tab member 60 is provided on the outer lower edge of each of the connector plates 26, 28 at the lower extremities of legs 12, 14. These tabs 60 allow the connection of successive leg members by the use of additional hinge arrangements, in the same manner as described above the hinge 16, so as to extend the web member 10 as desired.

The embodiment of FIGS. 8—11 provides for the hinged web assembly 61 to be manufactured with the legs 64, 66 joined with the hinge 62 in a single piece construction which, for example, can be stamped out of a material such as 20 gauge steel by the use of manufacturing techniques well known in the art. The hinge 62 includes a tab portion 68 which joins the connector plates 70, 72 at the respective upper ends of legs 64, 66. The hinge 62 also includes a connector link 74 which is formed from the inner portions of the connector plates 70, 72 as well as from side flanges which extend down the inner sides of the connector plates 70, 72. The connector link 74 includes a pair of generally planar end portions 71, 73 joined by a raised center portion 75 which defines a bore 77 when the web assembly 61 is in the close fitting, compact configuration of FIG. 11. Both the tab 68 and the connector link 74 are in general intended to be used on a one-time basis only, so as to position the web assembly components for connection to the wooden members.

At the lower extremities of the legs 64, 66, the hinge 62 and connector plate 76, 78 configurations are similar to those described for the upper portion of the assembly 61, having tab portion 68 and with the connector links 74 being formed from the outer portions of the connector plates 76, 78 at the lower ends of legs 64, 66. Thus the web assembly 61 may be manufactured as a continuous sheet or coil of interconnected web members.

As initially formed during manufacture, the web assembly 61 is in the form as shown in FIG. 11 with the legs aligned vertically in a compact arrangement. In one embodiment, the outer edges of the upper and lower connector plates are aligned parallel with the longitudinal axis of the legs as shown in FIG. 11, so that the respective connector plates of adjacent legs may be arranged in close contact for shipping and handling.

When it is desired to utilize the web assembly 61 in the construction of a joist, for example, adjacent legs of the web may be opened so as to lock the connector link 74 in a horizontal position as shown in FIG. 8, thus forming a V shaped section with adjacent leg members 64, 66. In one embodiment, the legs 64, 66 form an angle of approximately 45 degrees with the horizontal when the legs 64, 66 have been fully spread apart with the connector link 74 in the horizontal locked position. Successive V shaped configurations may be obtained by spreading apart the adjacent leg sections. Upon obtaining a web assembly of the desired length, the assembly may be separated from the remainder of the unopened web material by cutting the tab portion 68 and the connector link 74 of the hinge 62 at the appropriate locations.

In FIG. 9 there is shown a cross-sectional view from above the open connector link 74, also showing the teeth 80 of the connector plates 70, 72. FIG. 10 shows the side flanges 82, 84 which extend along the length of the legs 64, 66.

Figure 12:
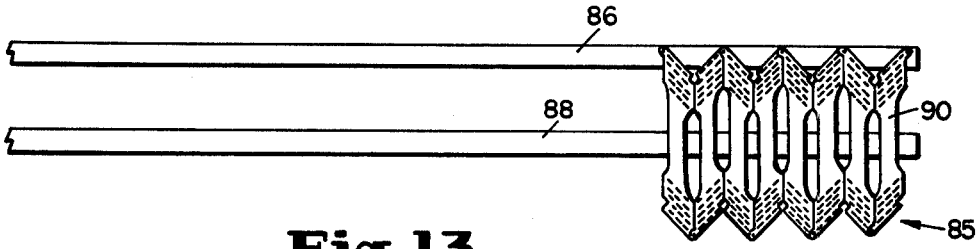
FIGS. 12 through 16 are schematic representations showing various stages in the construction of a joist structure by the use of the hinged metal web of the present invention.
Figure 13:
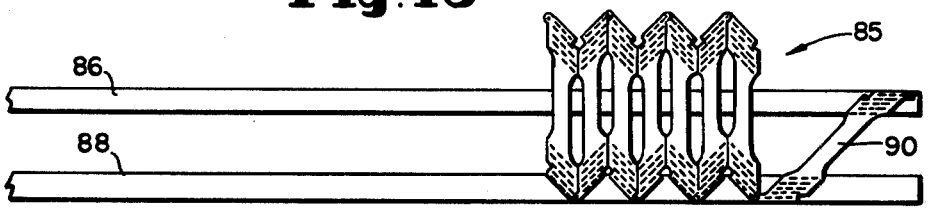
Figure 14:
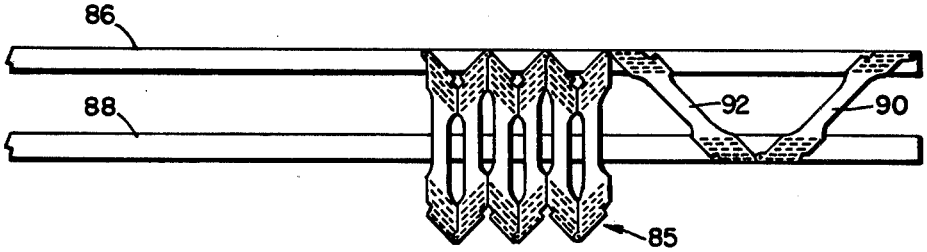
Figure 15:
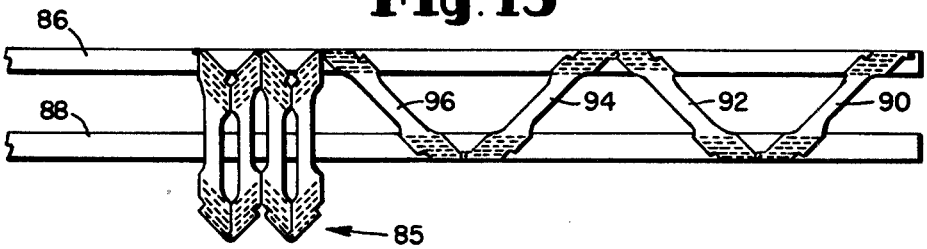
Figure 16:
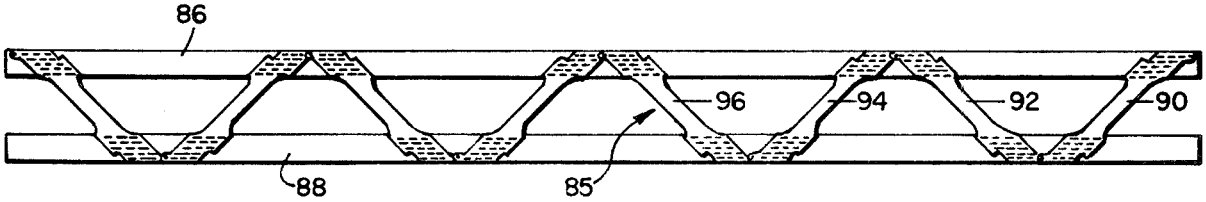

In FIGS. 12—16, there are shown various stages in the construction of a joist in accordance with the present invention. In FIG. 12, a web assembly 85 constructed in accordance with the present invention and being in a folded compact configuration is positioned at one end of a pair of wooden members 86, 88 such as 2×4 or 2×3 wooden strips, which are arranged in spaced apart, parallel relation on a suitable supporting surface. Upon forming the two leg members 90, 92 at one end of the assembly 85 into a V configuration, as shown in FIGS. 13 and 14, the connector plates at the upper and lower extremities of each leg 90, 92 are connected to the respective wooden member 86, 88 so that the teeth of each connector plate are embedded in the wood, as shown for example in FIG. 7. Successive leg members, 94, 96 are then positioned on the wooden members 86, 88, either singly or together, and connected to the members 86, 88 by embedding the teeth of the respective connector plates thereof. Upon completion of the installation of the eight leg-membered web assembly, the joist will have the appearance as shown in FIG. 16. A similar web assembly is installed on the opposite side of wooden members 86, 88 to provide a completed joist. The present invention may be employed in the construction of truss assemblies having a truss depth, for example, of from about 7 inches to about 12 inches.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A hinged metal web member for interconnecting elongated wooden members which are arranged so as to extend parallel to each other with a spacing therebetween, thus forming a truss or joist assembly capable of bearing substantial loads, said web member having a V-shaped formation in the operative position and being formed from a sheet metal plate, said hinged metal web member comprising: a pair of leg members; means for hingedly connecting said leg members at respective end portions thereof to form the apex of said V-shaped formation, each of said respective end portions including a connector plate; said hingedly connecting means allowing said leg members to be positioned between a close fitting, compact configuration in which the leg members extend generally parallel and a configuration in which the leg members define a V shape; said hingedly connecting means including a tab portion which joins the connector plates at said apex end portions, and a connector link extending between said apex end portions locking said legs in the V-shaped formation, said tab portion and said connector link being formed with said adjacent connector plates as a single piece construction with said connector link including a pair of generally planar end portions connected by a raised center portion which defines a bore when the web is in the compact configuration; a connector plate located at the extremity of each of said legs opposite said apex; each connector plate having struck out therefrom a plurality of teeth, all of said teeth extending from the same side of said hinged metal web member.

2. The hinged metal web of claim 1, further including means located on at least one of the connector plates at the extremities of said legs for connecting said hinged metal web to an adjacent web member.

3. A wooden truss assembly comprising two elongated wooden members spaced apart and a plurality of V-shaped hinged metal web members interconnecting said elongated wooden members, each of said hinged metal web members including: a pair of leg members; means for hingedly connecting said leg members at respective end portions thereof to form the apex of said V-shaped formation, each of said respective end portions including a connector plate; said hingedly connecting means allowing said leg members to be positioned between a close fitting, compact configuration in which the leg members extend generally parallel and a configuration in which the leg members define a V shape; said hingedly connecting means including a tab portion which joins the connector plates at said apex end portions, and a connector link extending between said apex end portions locking said legs in the V-shaped formation, said tab portion and said connector link being formed with said adjacent connector plates as a single piece construction with said connector link including a pair of generally planar end portions connected by a raised center portion which defines a bore when the web is in the compact configuration; a connector plate located at the extremity of each of said legs opposite said apex; each connector plate having struck out therefrom a plurality of teeth, all of said teeth extending from the same side of said hinged metal web member.

4. The wooden truss assembly of claim 3 further including means located on at least one of the connector plates at the extremities of said legs for connecting said hinged metal web to an adjacent web member.

5. A method of constructing a truss assembly which comprises:

(a) arranging two elongated wooden members in a spaced apart, generally parallel relationship; and (b) connecting said wooden members with at least one hinged metal web member, said hinged metal web member including: a pair of leg members; means for hingedly connecting said leg members at respective end portions thereof to form the apex of said V-shaped formation, each of said respective end portions including a connector plate; said hingedly connecting means allowing said leg members to be positioned between a close fitting, compact configuration in which the leg members extend generally parallel and a configuration in which the leg members define a V shape; said hingedly connecting means including a tab portion which joins the connector plates at said apex end portions, and a connector link extending between said apex end portions locking said legs in the V-shaped formation, said tab portion and said connector link being formed with said adjacent connector plates as a single piece construction with said connector link including a pair of generally planar end portions connected by a raised center portion which defines a bore when the web is in the compact configuration; a connector plate located at the extremity of each of said legs opposite said apex; each connector plate having struck out therefrom a plurality of teeth, all of said teeth extending from the same side of said hinged metal web member; said wooden members being connected by forming said hinged metal web member into a V-shaped configuration and embedding the teeth of said connector plates into said wooden members.

6. The method of claim 5, wherein said hinged metal web further includes means located on at least one of the connector plates at the extremities of said legs for connecting said hinged metal web to an adjacent web member.

* * * * *

UNITED STATES PATENT AND TRADEMARK OFFICE

CERTIFICATE OF CORRECTION

PATENT NO. : 4,483,120

DATED : November 20, 1984

INVENTOR(S) : Robert Gottlieb

It is certified that error appears in the above-identified patent and that said Letters Patent is hereby corrected as shown below:

In the Abstract, line 11, change the comma (,) to a period --.--.

Signed and Sealed this

*Twenty-first* Day of *May 1985*

[SEAL]

*Attest:*

DONALD J. QUIGG

*Attesting Officer* *Acting Commissioner of Patents and Trademarks*